US010012477B1

(12) United States Patent
Ell et al.

(10) Patent No.: US 10,012,477 B1
(45) Date of Patent: Jul. 3, 2018

(54) COORDINATING MULTIPLE ORDNANCE TARGETING VIA OPTICAL INTER-ORDNANCE COMMUNICATIONS

(71) Applicant: Rosemount Aerospace Inc., Burnsville, MN (US)

(72) Inventors: Todd Anthony Ell, Savage, MN (US); Martin Krucinski, Glastonbury, CT (US)

(73) Assignee: Rosemount Aerospace Inc., Burnsville, MN (US)

( * ) Notice: Subject to any disclaimer, the term of this patent is extended or adjusted under 35 U.S.C. 154(b) by 0 days.

(21) Appl. No.: 15/452,295

(22) Filed: Mar. 7, 2017

(51) Int. Cl.
*F41G 7/22* (2006.01)

(52) U.S. Cl.
CPC ..... *F41G 7/2233* (2013.01); *F41G 7/2246* (2013.01); *F41G 7/2253* (2013.01); *F41G 7/2293* (2013.01)

(58) Field of Classification Search
CPC .... F41G 7/2233; F41G 7/2246; F41G 7/2253; F41G 7/2293
USPC ..... 235/401, 404, 411
See application file for complete search history.

(56) References Cited

U.S. PATENT DOCUMENTS

| | | | | |
|---|---|---|---|---|
| 5,273,236 | A | 12/1993 | Wootton et al. | |
| 7,675,012 | B1 | 3/2010 | Bobinchak et al. | |
| 7,947,936 | B1 | 5/2011 | Bobinchak et al. | |
| 8,487,226 | B2 | 7/2013 | Biswell | |
| 9,157,717 | B1 | 10/2015 | Carroll et al. | |
| 9,476,677 | B1 * | 10/2016 | Wright | F41G 7/308 |
| 2006/0196383 | A1 * | 9/2006 | Parker | F42B 12/365 102/501 |
| 2014/0138473 | A1 * | 5/2014 | Yu | F41G 7/263 244/3.16 |

* cited by examiner

*Primary Examiner* — Toan Ly
(74) *Attorney, Agent, or Firm* — Kinney & Lange, P.A.

(57) ABSTRACT

Apparatus and associated methods relate to coordinating targeting among multiple guided ordnances using inter-ordnance optical communications. An inter-ordnance communications channel is optically established between leading and trailing guided ordnances travelling in substantially the same direction. The leading guided ordnance emits an optical beacon in a direction aft of the direction of ordnance travel, and a trailing guided ordnance captures images that contain the optical beacon emitted by the leading guided ordnance. The trailing guided ordnance is configured to chart a trajectory of the leading guided ordnance. The trailing guided ordnance is configured to predict which, among multiple targets identified in the captured images, is a first target consistent with the charted trajectory of and therefore selected by the leading ordnance. The trailing guided ordnance is further configured to select, based on the captured images, a second target that is within a navigable range of the trailing guided ordnance.

18 Claims, 5 Drawing Sheets

COORDINATING MULTIPLE ORDNANCE TARGETING VIA OPTICAL INTER-ORDNANCE COMMUNICATIONS

BACKGROUND

Military engagements sometimes involve what is known as "swarm attacks." A swarm attack is an attack against one or a few assets carried out by a great many—a swarm—of vehicles or weapons. The strategy of using a swarm of attacking vehicles is that, if even a few or only one of the attacking vehicles reaches its intended destination, the vehicle can still deliver a crippling blow to the attacked asset. Thus, an effective defense against a swarm attack must cripple or destroy all of the attacking vehicles or weapons of the swarm.

It can be difficult to provide such a defense against swarm attacks, especially if the number of defending weapons deployed is not significantly greater than the number of attacking vehicles. If the defender fires a weapon and waits to observe the effect before firing again, the swarm attack is more likely to be effective, especially if the weapon is fired from a great distance from the attacking vehicles. Thus, such swarm attacks can necessitate deployment of multiple weapons long before any of the deployed weapons have reached the attacking vehicles.

Often the deployed weapons are capable of selecting a target from amongst the attacking vehicles. Sometimes more than one of the deployed weapons will select the same target, however, from amongst the attacking vehicles. Therefore, even if more weapons are deployed than the number of attacking vehicles, there is no guarantee that every attacking vehicle will be targeted. Therefore, many more weapons than attacking vehicles are often deployed to minimize the probability that an attacking vehicle will escape unscathed. Such a defense strategy can be costly, and there is still no guarantee that the attack will be successfully defended, especially if the attacking vehicles are fast, suicidal, and/or many. A means for coordinating the targeting of multiple potential targets is therefore needed.

SUMMARY

Apparatus and associated devices relate to a system configured to be carried by a guided ordnance for in-flight target coordination with other guided ordnances. The system includes a forward-pointing optical imager configured to capture in-flight images of a scene aligned with an ordnance axis in a forward direction of ordnance travel. Each of the captured images includes a two-dimensional array of pixel data. The system includes an aft-pointing optical emitter configured to emit a first optical beacon in an aft direction of ordnance travel, thereby communicating to trailing guided ordnances. The system also includes a communications engine configured to identify, within the captured images, a second optical beacon emitted by a leading guided ordnance.

Some embodiments relate to a method for in-flight target coordination of at least a leading guided ordnance and a trailing guided ordnance. The method includes capturing, by the trailing guided ordnance, images of a scene aligned with an ordnance axis of the trailing guided ordnance. The method includes emitting, by the leading guided ordnance, an optical beacon in an aft direction of ordnance travel of the leading guided ordnance, thereby communicating to the trailing guided ordnance. The method also includes identifying, by the trailing guided ordnance, within the captured images, the optical beacon emitted by the leading guided ordnance.

Some embodiments relate to a system configured to be carried by a guided ordnance for in-flight target coordination with other guided ordnances. The system includes a microprocessor. The system also includes computer-readable memory encoded with instructions that, when executed by the microprocessor, cause the system to capture images of a scene aligned with an ordnance axis. The computer-readable memory encoded with instructions that, when executed by the microprocessor, cause the system to emit a first optical beacon in an aft direction of ordnance travel, thereby communicating to trailing guided ordnances. The computer-readable memory encoded with instructions that, when executed by the microprocessor, cause the system to identify, within the captured images, a second optical beacon emitted by a leading guided ordnance.

DETAILED DESCRIPTION

Apparatus and associated methods relate to coordinating targeting among multiple guided ordnances using inter-ordnance optical communications. The term 'ordnance' can refer to missiles, projectiles, munitions, or any type of airborne weapon. An inter-ordnance communications channel is optically established between leading and trailing guided ordnances travelling in substantially the same direction. Herein, guided ordnances are considered to be traveling in substantially the same direction if an angle between their ordnance axes is less than forty-five degrees or if a leading guided ordnance is within a field of view of a forward-pointing imager of a trailing guided ordnance. The leading guided ordnance emits an optical beacon in a direction aft of the direction of ordnance travel, and a trailing guided ordnance captures images that contain the optical beacon emitted by the leading guided ordnance. The trailing guided ordnance is configured to chart a trajectory of the leading guided ordnance. The trailing guided ordnance is configured to predict which, among multiple targets identified in the captured images, is a first target consistent with the charted trajectory of and therefore selected by the leading guided ordnance. The trailing guided ordnance is further configured to select, based on the captured images, a second target that is within a navigable range of the trailing guided ordnance.

Figure 1:
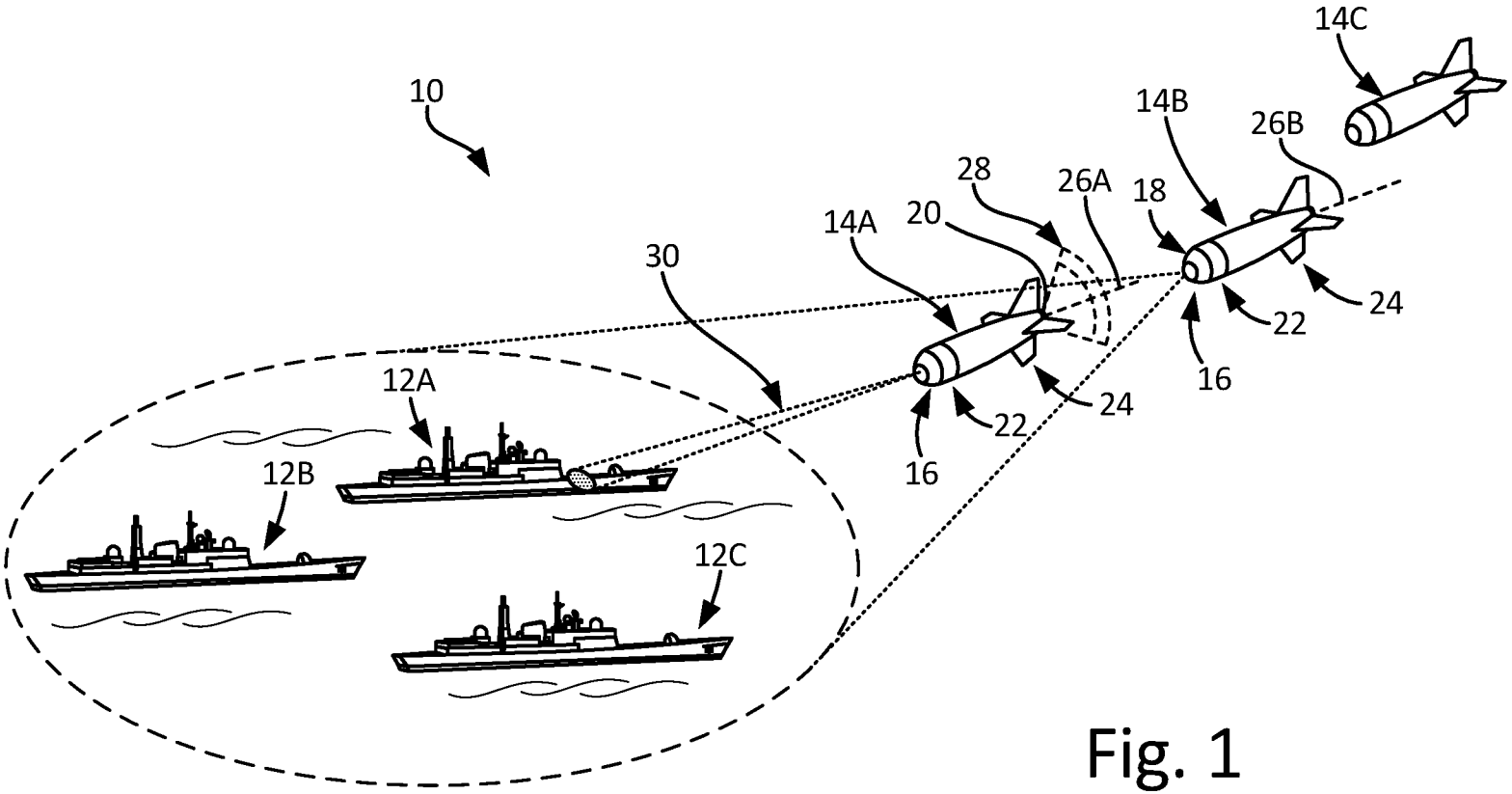
FIG. 1 is a schematic diagram of an exemplary scenario in which inter-ordnance communications can be used to coordinate ordnance targeting.

FIG. 1 is a schematic diagram of an exemplary scenario in which inter-ordnance communications can be used to coordinate ordnance targeting. In FIG. 1, battle arena 10 includes a swarm of enemy boats 12A, 12B and 12C. A salvo of guided ordnances 14A, 14B and 14C has been launched to engage enemy boats 12A, 12B and 12C. Each of guided ordnances 14A, 14B and 14C is equipped with target coordination system 16. Target coordination system 16 includes forward-pointing optical imager 18, aft-pointing optical emitter 20, image processor 22, and Guidance, Navigation and Control (GNC) module 24. Forward-pointing optical imager 18 of leading (with respect to guided ordnances 14B and 14C) guided ordnance 14A is depicted capturing in-flight images of battle arena 10 aligned with ordnance axis 26A in a forward direction of ordnance travel. Image processor 22 of leading guided ordnance 14A identifies, within the captured images, enemy boats 12A, 12B and 12C. GNC module 24 of leading guided ordnance 14A selects enemy boat 12A, from enemy boats 12A, 12B and 12C, for targeting. GNC module 24 of leading guided ordnance 14A can determine a direction of targeted enemy boat 12A. GNC module 24 of leading guided ordnance 14A can generate an output signal indicative of the determined direction of targeted enemy boat 12A relative to ordnance axis 26A. The generated output signal can be used to orient flight control surfaces so as to direct leading guided ordnance 14A to targeted enemy boat 12A.

Aft-pointing optical emitter 20 of leading guided ordnance 14A is depicted emitting optical beacon 28 in an aft direction of ordnance travel. Optical beacon 28 communicates at least a position of leading guided ordnance 14A to guided ordnances 14B and 14C, which are trailing relative to guided ordnance 14A. Forward-pointing optical imager 18 of guided ordnance 14B is depicted capturing in-flight images of battle arena 10 aligned with ordnance axis 26B in a forward direction of ordnance travel. Forward-pointing optical imager 18 of guided ordnance 14B can also capture leading guided ordnance 14A in the in-flight images if guided ordnance 14A is leading with respect to guided ordnance 14B and if guided ordnance 14A is within a field of view of forward-pointing optical imager 18 of guided ordnance 14B. Optical beacon 28 emitted by leading guided ordnance 14A can facilitate an identification of leading guided ordnance 14A in the in-flight images captured by trailing guided ordnances 14B and 14C.

Image processor 22 of guided ordnance 14B is configured to identify, within the captured images, optical beacon 28 emitted by leading guided ordnance 14A. Image processor 22 is also configured to identify, within the captured images, enemy boats 12A, 12B and 12C. Identification of optical beacon 28 emitted by leading guided ordnance 14A and identifying enemy boats 12A, 12B and 12C can include identifying image portions within the captured images corresponding to optical beam 28 and enemy boats 12A, 12B and 12C. Each identified image portion can include a subset of a two-dimensional array of pixel data, the subsets corresponding to pixel locations upon which optical beacon 28 and enemy boats 12A, 12B and 12C have been imaged.

GNC module 24 of guided ordnance 14B can be configured to chart a trajectory of leading guided ordnance 14A. The trajectory can be charted based on a time sequence of images that capture optical beacon 28 of leading guided ordnance 14A. GNC module 24 can be further configured to predict, based on the charted trajectory of leading guided ordnance 14A, which of enemy boats 12A, 12B and 12C leading guided ordnance 14A has selected for targeting. By predicting which of enemy boats 12A, 12B and 12C leading guided ordnance 14A has selected for targeting, guided ordnance 14B can avoid targeting the same enemy boat 12A targeted by leading guide ordnance 14A, and can select among the remaining untargeted enemy boats 12B and 12C. GNC module 24 of guided ordnance 14B can select for targeting enemy boat 12B, for example, if within a navigable range of the guided ordnance 14B.

GNC module 24 of guided ordnance 14B then can determine a direction of targeted enemy boat 12B. GNC module 24 of guided ordnance 14B also can generate an output signal indicative of the determined direction of targeted enemy boat 12B relative to ordnance axis 26B. The generated output signal can be used to orient flight control surfaces of guided ordnance 14B so as to control the flight of guided ordnance 14B to targeted enemy boat 12B. Although not depicted in FIG. 1, guided ordnance 14B can generate an optical beacon to communicate with other guided ordnances located aft of guided ordnance 14B, such as, for example, guided ordnance 14 in depicted battle arena 10. The timing of emission of optical beacons can be time staggered to facilitate identification of guided ordnances 14A and 14B by trailing guided ordnance 14C.

In a similar manner, trailing guided ordnance 14C can identify both guided ordnances 14A and 14B in the in-flight images obtained by trailing guided ordnance 14C, by identifying the optical beacons emitted by guided ordnances 14A and 14B. Trailing guided ordnance 14C can then chart trajectories for both guided ordnances 14A and 14B. Trailing guided ordnance 14C can predict, based on the charted trajectories, which of enemy boats 12A, 12B and 12C have been selected by each of guided ordnances 12A and 12B. Guided ordnance 12C can then select among the unselected enemy boats—in the depicted embodiment only enemy boat 12C is untargeted—enemy boat 12C for targeting.

In FIG. 1, guided ordnance 14A also includes a forward-pointing target illuminator projecting a target illumination beam 30 onto targeted enemy boat 12A. Target illumination beam 30 can be used to designate which of enemy boats 12A, 12B and 12C has been selected for targeting by guided ordnance 14A by illuminating targeted enemy boat 12A. Guided ordnances 14B and 14C can then identify the illuminated target within the in-flight images captured by guided ordnances 14B and 14C. Guided ordnances 14B and 14C can then avoid selecting targeted enemy boat 12A designated by guided ordnance 14A. In some embodiments, forward-pointing target illuminator 30 of guided ordnance 12A is configured to provide an illumination beam in a forward-pointing direction along ordnance axis 26A. In some embodiments, forward-pointing target illuminator 30 can direct the illumination beam within a limited solid angle about ordnance axis 26A. Using a forward-pointing target illuminator to identify target selection can be used alternatively or in conjunction with using an aft-pointing optical beacon.

In some embodiments, especially in embodiments in which the forward-pointing target illuminator has a fixed alignment with respect to ordnance axis 26A, the forward-pointing target illuminator may illuminate battle scene 10 at a location that leads targeted enemy boat 12A, as guided ordnance 14A may have a flight path that leads targeted enemy boat 12A. In such embodiments, GNC 24 of trailing guided ordnances 14B and 14C may predict which of enemy boats 12A, 12B and 12C has been selected by calculating the paths of travel of enemy boats 12A, 12B and 12C. For example, GNC 24 may predict that enemy boat 12A has been selected by leading guided ordnance 14A because the calculated path of travel of enemy boat 12A is consistent with the leading location of target illumination beam 30.

In some embodiments, one or both of optical beacon 28 and target illumination beam 30 can be modulated to encode information for communication with other guided ordnances of a salvo, such as guided ordnances 14B and 14C. Target selection information, source identification information, or other information can be encoded in optical beacon 28 and/or target illuminating beam 30. For example, such communications can be used to coordinate timing of arrival of guided ordnances 14A, 14B and 14C. In some embodiments, multiple guided ordnances may coordinate a simultaneous attack on a single target. For example, such communications can be used to coordinate relative positions with respect to the target where each of the multiple ordnances will explode (e.g., North, West, South, and East of the target). Such communications can be used to coordinate altitudes of detonation of each of multiple ordnances, for example. In some embodiments, optical beacon 28 and/or target illumination signal 30 can encode assessed target values to communicate to other guided ordnances. For example, guided ordnance 14A can solicit one or more other guided ordnances to join its pursuit of a high value target in a swarm manner. Conversely, guided ordnance 14A can communicate that a designated target is a friendly asset that should not be harmed.

Figure 2:
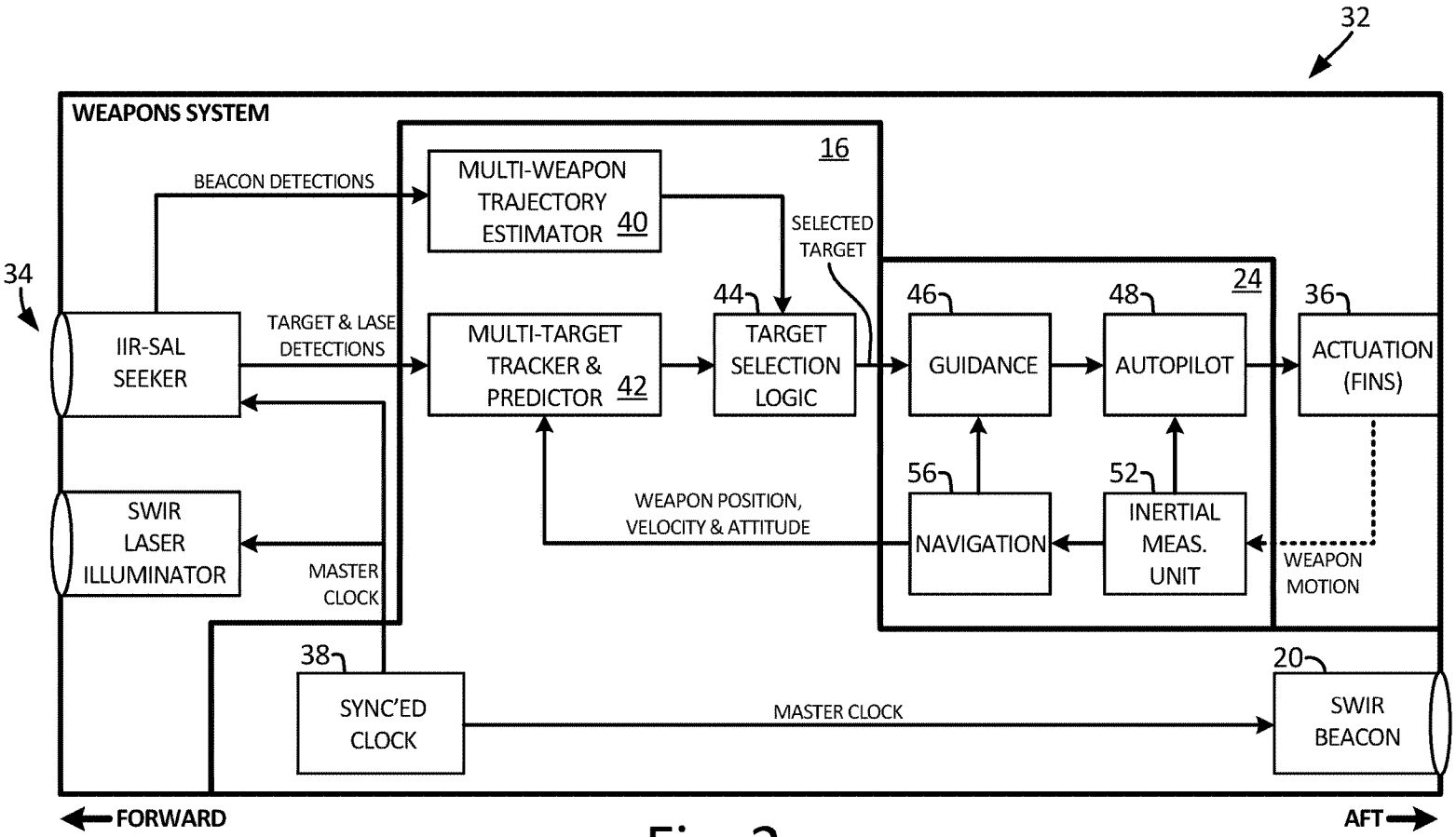
FIG. 2 is a block diagram of an exemplary weapon system having a dual-mode seeker and a target coordination system.

FIG. 2 is a block diagram of an exemplary weapon system having a dual-mode seeker and a target coordination system. In FIG. 2, weapon system 32 includes a dual-mode seeker 34, target coordination system 16, Guidance, Navigation, and Control (GNC) module 24, and flight control surfaces 36. Tri-mode seeker 34 includes both a Semi-Active Laser (SAL) image seeking subsystem and a passive/active image seeking subsystem. The SAL image seeking subsystem and the passive/active image seeking subsystem acquire a designated target using different technologies. With the SAL image seeking subsystem, laser radiation reflected from the designated target is received and processed to provide guidance commands to precision guided weapon system 32. Laser radiation may be generated and transmitted from laser target designator manned by a forward observer, for example. The forward observer directs the laser radiation to a designated target, thereby designating the laser-illuminated target. The SAL image seeking subsystem of precision guided weapon system 32, which is remotely located from both the laser-designated target and laser target designator, can then detect the laser radiation reflected from the designated target. The SAL image seeking subsystem may include processing electronics for generating guidance commands to precision guided weapon system 32. Such guidance commands may use a targeting direction derived from a captured image of the laser radiation reflected from the designated target and imaged by the SAL image seeking subsystem. The SAL image seeking subsystem can be used to identify the designated target and to guide precision guided weapon system 32 to the laser-designated target. To achieve an optimally precise hit on the designated target, the forward observer may illuminate the designated target until precision guided weapon system 32 impacts designated target.

The passive/active image seeking subsystem may rely on automatic target tracking algorithms that distinguish an image of the designated target from background clutter under ambient lighting conditions. The passive/active image seeking subsystem may not require active designation by a forward observer. Acquiring the designated target using the passive/active image seeking subsystem can be difficult in certain situations, though. The passive image seeking subsystem may have difficulties, for example, in certain weather conditions and/or when the passive image seeking subsystem is at great distances from the designated target, as the designated target may be imaged onto one or few pixels of a focal plane array at such great distances. The passive/active image seeking subsystem can use sophisticated Automatic Target Acquisition/Recognition (ATA/ATR) algorithms that require demanding processing resources. Being able to SAL designate and to passively/actively track the designated target may eliminate the need for a forward observer to illuminate the designated target throughout the entire flight of precision guided weapon system 32 till impact. Artificial intelligence routines that recognize various types of targets in the captured images can provide guidance information for precision guided weapon system 32 as it nears the designated target. Moreover, when the passive image seeking subsystem is passively tracking the designated target, any rapid changes in illumination, as could be caused by laser radiation from an active laser target designator, can cause difficulties in target recognition.

In order to switch from using the SAL image seeking subsystem to the passive/active image seeking subsystem for tracking of a designated target, images of the designated target for the SAL seeking and the passive/active image seeking subsystems can be concurrently provided, even while the laser target designator is active. Tri-mode seeker 34 includes forward-pointing optical imager 18 (shown in FIG. 1) to provide concurrent images for both the SAL seeking and the passive/active image seeking subsystems. Forward-pointing optical imager 18 can be logically associated either with tri-mode seeker 34 and/or with target coordinating system 16. Tri-mode seeker 34 also includes a laser illuminator for producing target illumination beam 30 (shown in FIG. 1), which also could be logically associated with target coordinating system 16.

Multi-target coordination system 16 includes synchronization clock 38, multi-weapon trajectory estimator 40, multi-target tracker and predictor 42, target selection logic 44 and aft-pointing optical emitter 20. Multi-weapon trajectory estimator 40 is configured to chart trajectories of leading guided ordnances captured in images produced by forward-pointing optical imager 18. Multi-target tracker and predictor 42 is configured to identify one or more image portions within the images produced by forward-pointing optical imager 18. Each image portion includes a subset of the two-dimensional array of pixel data corresponding to a target in the aligned scene. In some embodiments, multi-target tracker and predictor 42 is further configured to chart a trajectory of each of the targets corresponding to the identified image portions.

Target selection logic 44 is configured to receive a signal(s) indicative of the charted trajectories of the leading guided ordnances from multi weapon trajectory estimator 40, and signal(s) indicative of the locations, and/or trajectories of the targets imaged within the battle scene, from multi-target tracker and predictor 42. Target selection logic 44 is then configured to predict which of the imaged targets have been selected by the leading guided ordnances, and which of the imaged targets remain unselected. Target selection logic 44 is then configured to select one of the imaged targets to which to guide weapons system 32. Target coordination system 16 also includes aft-pointing optical emitter 20, which emits optical beacon 28 (depicted in FIG. 1) in an aft direction of ordnance travel. This aft-directed optical beacon can be imaged by forward-pointing optical imagers 18 of trailing weapon systems 32.

In some embodiments, target selection logic 44 generates a signal indicative of the direction of the selected target and outputs the generated signal to GNC module 24. GNC module 24 includes guidance system 46, autopilot 48, navigation system 50 and inertial measurement system 52. GNC module 24 is configured to generate signals that control flight control surfaces 36 so as to guide weapon system 32 to the target selected by target coordination system 16.

Figure 3:
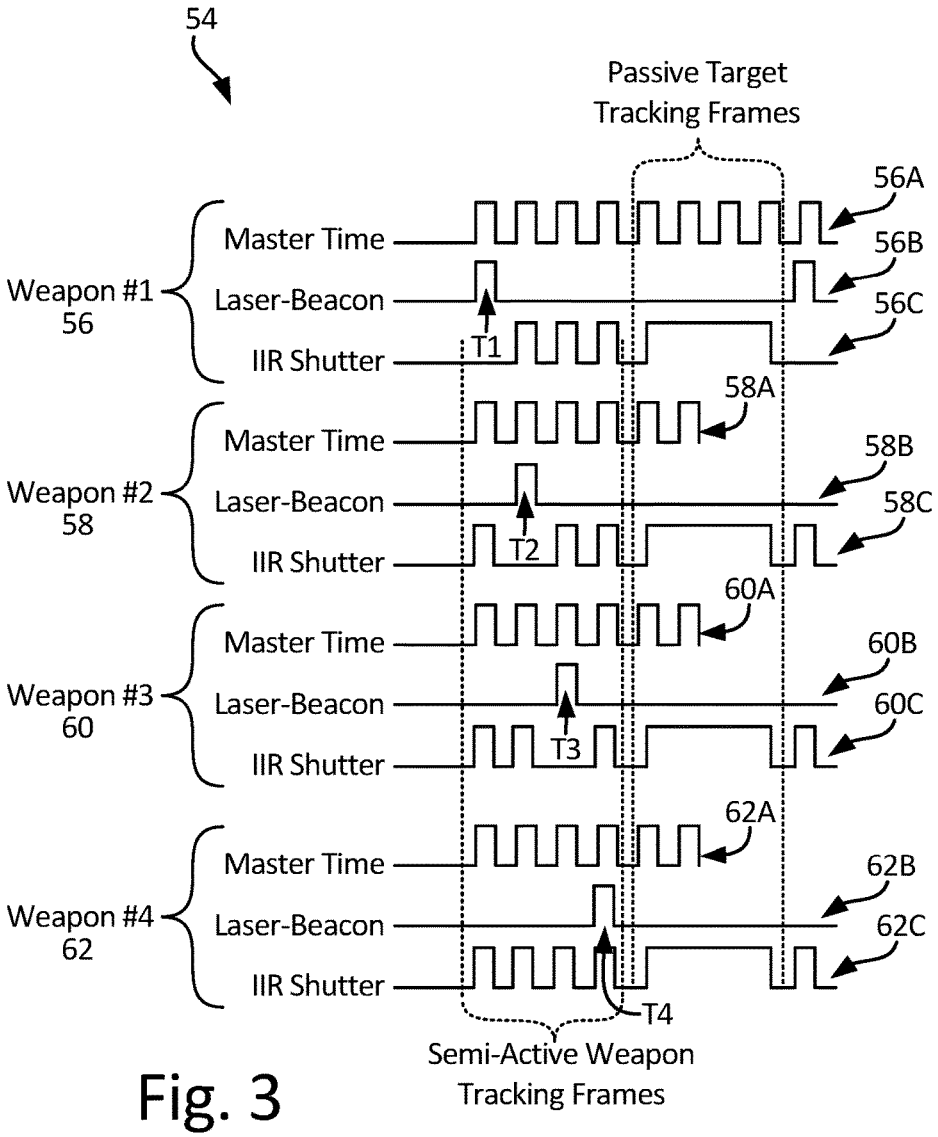
FIG. 3 is a timing diagram showing the temporal coordination of inter-ordnance communications.

FIG. 3 is a timing diagram showing the temporal coordination of inter-ordnance communications. In FIG. 3, timing diagram 54 depicts four sets of timing signals 56, 58, 60 and 62, each corresponding to a different guided ordnance of a salvo of guided ordnances. The salvo gives order to the guided ordnances in a sequence. Thus a first guided ordnance is given flight, followed by a second guided ordnance, and so forth. Sets 56, 58, 60 and 62 of timing signals correspond to the first, second, third and fourth guided ordnances of the salvo, respectively. Each of the guided ordnances in the sequence has synchronization clock 38 (shown in FIG. 2) to provide synchronization of emitted optical beacon 28 (shown in FIG. 1). Synchronization clocks 38 of each of the guided ordnances in the salvo are synchronized to one another.

Timing signals 56A, 58A, 60A, and 62A depict master clock signals generated by synchronized clocks 38 of the first, second, third and fourth guided ordnance, respectively. Timing signals 56B, 58B, 60B and 62B correspond to timings of emission of optical beacons 28 and/or target illumination beams 30 (depicted in FIG. 1) of first, second, third and fourth guided ordnance, respectively. The first guided ordnance emits optical beacon 28 and/or target illumination beam 30 during the first period of each of master clock signals 56A, 58A, 60A and 62A. The second, third, and fourth guided ordnances emit optical beacons 28 and/or target illumination beams 30 during the second, third, and fourth periods, respectively, of each of master clock signals 56A, 58A, 60A and 62A. In this way, each of the trailing guided ordnances that image the optical beacons 28 can identify each of the leading guided ordnances based on when the optical beacons 28 are received. Because each of the trailing guided ordnances can identify each of the leading guided ordnances, based on the timings of optical beacons 28, the trailing guided ordnances can chart the trajectories of each of the identified guided ordnances.

Timing signals 56C, 58C, 60C, and 62C depict timings for capturing images by forward-pointing optical imagers 18 of the first, second, third and fourth guided ordnance, respectively. Timing signals 56C, 58C, 60C, and 62C are coordinated with timing signals 56B, 58B, 60B and 62B so as to capture images when aft-pointing optical emitters 20 emit optical beacons 28. Timing signals 56C, 58C, 60C, and 62C also provide shutter timing for capturing images when no aft-pointing optical emitters 20 are emitting optical beacons 28. Targets can be passively tracked using images captured when targets are not illuminated by target illumination beams 30 and guided ordnances are not emitting optical beacons 28. If the tri-mode seeker is operating in the active mode, the forward-pointing illuminator of the ordnance is illuminated when its seeker is imaging (not shown in the figures).

Figure 4B:
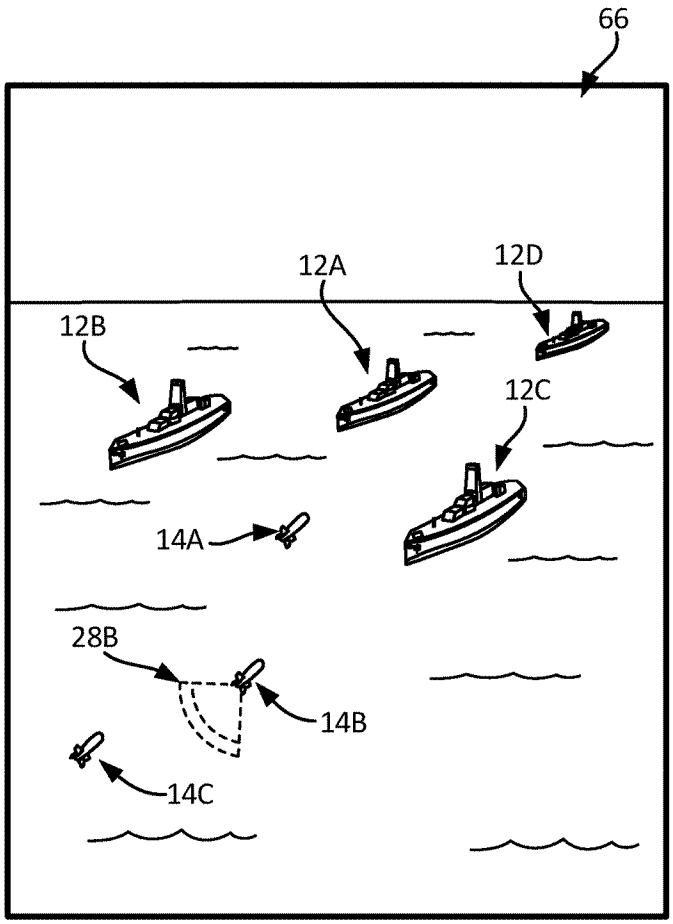
FIGS. 4A and 4B are in-flight images captured by an imager of a trailing guided ordnance.
Figure 4A:
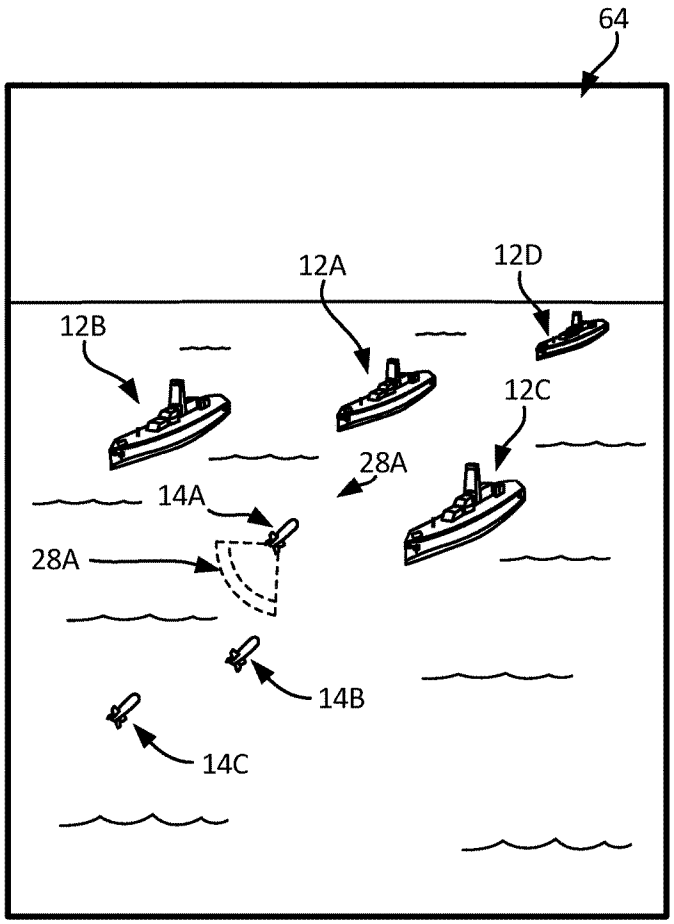

FIGS. 4A and 4B are in-flight images captured by an imager of a trailing guided ordnance. In FIG. 4A, captured image 64 depicts four enemy boats 12A, 12B, 12C and 12D, and leading guided ordnances 14A, 14B and 14C of a salvo of guided ordnances deployed to engage enemy boats 12A, 12B, 12C and 12D. Image 64 is captured by forward-pointing optical imager 18 of the fourth and trailing guided ordnance of a salvo that also includes guided ordnances 14A, 14B and 14C. Captured image 64 is taken during time interval T1, which is synchronized to coincide with the emission of optical beacon 28A of first leading guided ordnance 14A of the salvo. The trailing guided ordnance can determine which of the imaged ordnances 14A, 14B and 14C is the first guided ordnance of the salvo by determining which of guided ordnances 14A, 14B and 14C is emitting optical beacon 28A (indicated by the circumferential dashes surrounding guided ordnance 14A) at time interval T1, which is the time interval corresponding to the beacon emission of the second ordnance of the salvo.

Multi-weapon trajectory estimator 40 (depicted in FIG. 2) of the trailing guided ordnance from which captured image 64 is generated, charts a trajectory of first leading guided ordnance 14A. Multi-target tracker and predictor 42 (depicted in FIG. 2) of the trailing guided ordnance from which captured image 64 is generated, locates and/or charts trajectories of enemy boats 12A, 12B, 12C and 12D. Target selection logic 44 (depicted in FIG. 2) selects and/or predicts, based on the generated trajectory of first leading guided ordnance 14A, and the generated trajectories of enemy boats 12A, 12B, 12C and 12D, which of enemy boats 12A, 12B, 12C and 12D has been selected by first leading guided ordnance 14A for targeting.

In FIG. 4B, captured image 66 again depicts four enemy boats 12A, 12B, 12C and 12D, and leading guided ordnances 14A, 14B and 14C. Image 66 is also captured by forward-pointing optical imager 18 of the fourth and trailing guided ordnance of the salvo that also includes leading guided ordnances 14A, 14B and 14C. Captured image 66 is taken at time interval T2, which is synchronized to coincide with the emission of optical beacon 28B of the second leading guided ordnance 14B of the salvo. The trailing guided ordnance can determine which of the imaged leading guided ordnances 14A, 14B and 14C is the second guided ordnance of the salvo by determining which of leading guided ordnances 14A, 14B and 14C is emitting optical beacon 28B (indicated by the circumferential dashes surrounding second leading guided ordnance 14B) at time interval T2, which is the time interval corresponding to the beacon emission of the second ordnance of the salvo.

Multi-weapon trajectory estimator 40 (depicted in FIG. 2) of the trailing guided ordnance from which captured image 66 is generated, charts a trajectory of second leading guided ordnance 14B. Multi-target tracker and predictor 42 (depicted in FIG. 2) of the trailing guided ordnance from which captured image 66 is generated, locates and/or charts trajectories of enemy boats 12A, 12B, 12C and 12D. Target selection logic 44 (depicted in FIG. 2) selects and/or predicts, based on the generated trajectory of second leading guided ordnance 14B, and the generated trajectories of enemy boats 12A, 12B, 12C and 12D, which of enemy boats 12A, 12B, 12C and 12D has been selected by guided ordnance 14B for targeting.

This sequence of steps is again repeated at time interval T3 to identify which of leading guided ordnances 14A, 14B and 14C is the third guided ordnance of the salvo. The trajectory of the identified third guided ordnance is then charted and the target of the third guided ordnance is predicted. Then, after all the leading guided ordnances 14A, 14B and 14C have been identified and their targets predicted, the fourth guided ordnance in the salvo can select, from among enemy boats 12A, 12B, 12C and 12D, a target. At time interval T4, the fourth guided ordnance emits optical beacon 28 of its own to provide an identification signal to other trailing guided ordnances of the salvo (e.g., a fifth or sixth guided ordnance of the salvo). Using such optical beacons 28 and synchronization clocks 38, guided ordnances of the salvo can coordinate targeting of multiple potential targets.

Figure 5:
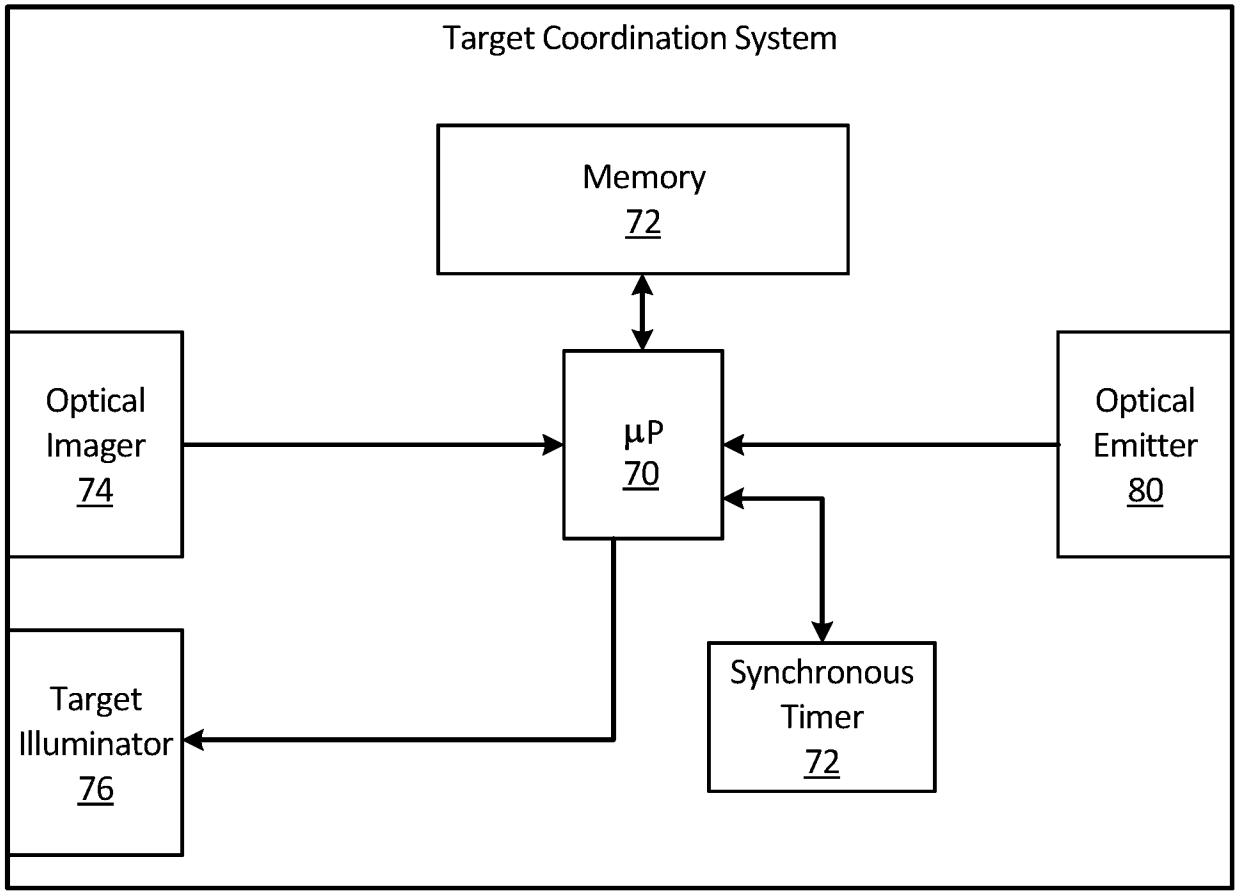
FIG. 5 is a block diagram of an embodiment of a target coordination system.

FIG. 5 is a block diagram of an embodiment of a target coordination system. In FIG. 5, target coordination system 68 includes processor(s) 70, memory 72, forward-pointing optical imager 74, forward-pointing target illuminator 76, synchronous timer 78, and aft-pointing optical emitter 80. Processor(s) 70 is electrically connected to each of memory 72, forward-pointing optical imager 74, forward-pointing target illuminator 76, synchronous timer 78, and aft-pointing optical emitter 80. Processor(s) 70 controls the generation of target illumination beam 30 (depicted in FIG. 1) generated by forward-pointing target illuminator 76 and optical beacon 28 (depicted in FIG. 1) generated by aft-pointing optical emitter 80. Processor(s) 70 receives captured images generated by forward-pointing optical imager 74 and performs image processing operations necessary for target coordination. Processor(s) 70 is also in electrical communication with memory 72.

In certain examples, target coordination system 68 can include more or fewer components. Processor(s) 70, in one example, is configured to implement functionality and/or process instructions for execution within target coordination system 68. For instance, processor(s) 70 can be capable of processing instructions stored in memory 72. Examples of processor(s) 70 can include any one or more of a microprocessor, a controller, a digital signal processor (DSP), an application specific integrated circuit (ASIC), a field-programmable gate array (FPGA), or other equivalent discrete or integrated logic circuitry.

Memory 72 can be configured to store information within target coordination system 68 during operation. Memory 72, in some examples, is described as computer-readable storage media. In some examples, a computer-readable storage medium can include a non-transitory medium. The term "non-transitory" can indicate that the storage medium is not embodied in a carrier wave or a propagated signal. In certain examples, a non-transitory storage medium can store data that can, over time, change (e.g., in RAM or cache). In some examples, memory 72 is a temporary memory, meaning that a primary purpose of memory 72 is not long-term storage. Memory 72, in some examples, is described as volatile memory, meaning that memory 72 does not maintain stored contents when power to target coordination system 68 is turned off. Examples of volatile memories can include random access memories (RAM), dynamic random access memories (DRAM), static random access memories (SRAM), and other forms of volatile memories. In some examples, memory 72 is used to store program instructions for execution by processor(s) 70. Memory 72, in one example, is used by software or applications running on target coordination system 68 (e.g., a software program implementing designated target detection) to temporarily store information during program execution.

Memory 72, in some examples, also includes one or more computer-readable storage media. Memory 72 can be configured to store larger amounts of information than volatile memory. Memory 72 can further be configured for long-term storage of information. In some examples, memory 72 includes non-volatile storage elements. Examples of such non-volatile storage elements can include magnetic hard discs, optical discs, flash memories, or forms of electrically programmable memories (EPROM) or electrically erasable and programmable (EEPROM) memories. Memory 72 can include program segments, pulse detector segments, pattern sequence recognition segments, and image processing segments, etc.

The following are non-exclusive descriptions of possible embodiments of the present invention.

Apparatus and associated methods relate to a system configured to be carried by a guided ordnance for in-flight target coordination with other guided ordnances. The system includes a forward-pointing optical imager configured to capture in-flight images of a scene aligned with an ordnance axis in a forward direction of ordnance travel. Each of the captured images includes a two-dimensional array of pixel data. The system includes an aft-pointing optical emitter configured to emit a first optical beacon in an aft direction of ordnance travel, thereby communicating to trailing guided ordnances. The system also includes an image processor configured to identify, within the captured images, a second optical beacon emitted by a leading guided ordnance.

The system of the preceding paragraph can optionally include, additionally and/or alternatively, any one or more of the following features, configurations and/or additional components:

For Example, a system configured to be carried by a guided ordnance for in-flight target coordination with other guided ordnances according to an exemplary embodiment of this disclosure, among other possible things can further include a Guidance, Navigation, and Control (GNC) module configured to chart a trajectory of the leading guided ordnance. The trajectory of the leading guided ordnance can be charted based on the identified optical beacon emitted by the leading guided ordnance.

A further embodiment of any of the foregoing systems, further including a target identifier configured to identify one or more image portions within the captured images. Each image portion can include a subset of the two-dimensional array of pixel data corresponding to a target in the aligned scene.

A further embodiment of any of the foregoing systems, further including a target selector configured to predict a first target selected by the leading guided ordnance. The first target can correspond to a first one of the one or more image portions. The first target can be based on the charted trajectory of the leading guided ordnance. The target selector can be further configured to select a second target corresponding to a second one of the one or more image portions. The second target can be located within a navigable range of the guided ordnance.

A further embodiment of any of the foregoing systems, wherein the GNC module is further configured to determine a direction of the second target relative to the ordnance axis. The GNC module can be further configured to generate an output signal indicative of the determined direction of the selected target relative to the ordnance axis.

A further embodiment of any of the foregoing systems, further including a forward-pointing target illuminator configured to project an optical signal in a forward direction of ordnance travel.

A further embodiment of any of the foregoing systems, wherein the forward-pointing target illuminator is a Short Wave InfraRed (SWIR) laser.

A further embodiment of any of the foregoing systems, further including an image processor configured to identify, within the captured images, the optical signal projected by the leading guided ordnance.

A further embodiment of any of the foregoing systems, wherein the trajectory of the leading guided ordnance is charted based on the identified optical signal projected by the leading guided ordnance.

A further embodiment of any of the foregoing systems, wherein the aft-pointing optical emitter is further configured to modulate the optical beacon to communicate information to the trailing guided ordnances.

A further embodiment of any of the foregoing systems, further including a synchronous timer configured to provide signals corresponding to timings of the first and second optical beacons.

In some embodiments, apparatus and associated methods relate to a method for in-flight target coordination of at least a leading guided ordnance and an trailing guided ordnance. The method includes capturing, by the trailing guided ordnance, images of a scene aligned with an ordnance axis of the trailing guided ordnance. The method includes emitting, by a leading guided ordnance, an optical beacon in an aft direction of travel by the leading guided ordnance, thereby communicating to the trailing guided ordnance. The method identifying, by the trailing guided ordnance, within the captured images, the optical beacon emitted by the leading guided ordnance.

The method of the preceding paragraph can optionally include, additionally and/or alternatively, any one or more of the following features, configurations and/or additional components:

For Example, a method for in-flight target coordination of at least a leading guided ordnance and an trailing guided ordnance according to an exemplary embodiment of this disclosure, among other possible things can further include charting, by the trailing guided ordnance, a trajectory of the leading guided ordnance.

A further embodiment of any of the foregoing methods, wherein the trajectory of the leading guided ordnance is charted based on the identified optical beacon emitted by the leading guided ordnance.

A further embodiment of any of the foregoing methods, further including identifying, by the trailing guided ordnance, a plurality of image portions within the captured images, each corresponding to one of a plurality of targets in the aligned scene. The method can further include predicting, by the trailing guided ordnance, a first target of the plurality of targets selected by the leading guided ordnance, the first target corresponding to a first one of the plurality of image portions, the first target predicted based on the charted trajectory of the leading guided ordnance. The method can also include selecting, by the trailing guided ordnance, a second target corresponding to a second one of the plurality of image portions, the second target located within a navigable range of the trailing guided ordnance.

A further embodiment of any of the foregoing methods, further including determining, by the trailing guided ordnance, a direction of the second target relative to the ordnance axis. The method can further include generating, by the trailing guided ordnance, an output signal indicative of the determined direction of the selected target relative to the ordnance axis.

A further embodiment of any of the foregoing methods, further including projecting, by the leading guided ordnance, an optical signal in a forward direction of ordnance travel.

A further embodiment of any of the foregoing methods, further including identifying, by the trailing guided ordnance, within the captured images, the optical signal projected by the leading guided ordnance.

A further embodiment of any of the foregoing methods, further including modulating, by the leading guided ordnance, the optical beacon to communicate information to the trailing guided ordnance.

In some embodiments apparatus and associated methods relate to a system configured to be carried by a guided ordnance for in-flight target coordination with other guided ordnances. The system includes a microprocessor and computer-readable memory encoded with instructions. The instructions, when executed by the microprocessor, cause the system to capture images of a scene aligned with an ordnance axis. The instructions, when executed by the microprocessor, cause the system to emit a first optical beacon in an aft direction of ordnance travel, thereby communicating to trailing guided ordnances. The instructions, when executed by the microprocessor, also cause the system to identify, within the captured images, a second optical beacon emitted by a leading guided ordnance.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A system configured to be carried by a guided ordnance for in-flight target coordination with other guided ordnances, the system comprising:

a forward-pointing optical imager configured to capture in-flight images of a scene aligned with an ordnance axis in a forward direction of ordnance travel, each of the captured images comprising a two-dimensional array of pixel data;

an aft-pointing optical emitter configured to emit a first optical beacon in an aft direction of ordnance travel, thereby communicating to trailing guided ordnances;

an image processor configured to identify, within the captured images, a second optical beacon emitted by a leading guided ordnance; and a Guidance, Navigation, and Control (GNC) module configured to chart a trajectory of the leading guided ordnance.

2. The system of claim 1, wherein the trajectory of the leading guided ordnance is charted based on the identified optical beacon emitted by the leading guided ordnance.

3. The system of claim 1, further comprising:

a target identifier configured to identify one or more image portions within the captured images, each image portion comprising a subset of the two-dimensional array of pixel data corresponding to a target in the aligned scene; and a target selector configured to predict a first target selected by the leading guided ordnance, the first target corresponding to a first one of the one or more image portions, the first target based on the charted trajectory of the leading guided ordnance, the target selector further configured to select a second target corresponding to a second one of the one or more image portions, the second target located within a navigable range of the guided ordnance.

4. The system of claim 3, wherein the GNC module is further configured to:

determine a direction of the second target relative to the ordnance axis; and generate an output signal indicative of the determined direction of the selected target relative to the ordnance.

5. The system of claim 1, further comprising:

a forward-pointing target illuminator configured to project an optical signal in a forward direction of ordnance travel.

6. The system of claim 5, wherein the forward-pointing target illuminator is a Short Wave InfraRed (SWIR) laser.

7. The system of claim 6, further comprising:

an image processor configured to identify, within the captured images, the optical signal projected by the leading guided ordnance.

8. The system of claim 7, wherein the trajectory of the leading guided ordnance is charted based on the identified optical signal projected by the leading guidance ordnance.

9. The system of claim 1, wherein the aft-pointing optical emitter is further configured to modulate the optical beacon to communicate information to the trailing guided ordnances.

10. The system of claim 1, further comprising:

a synchronous timer configured to provide signals corresponding to timings of the first and second optical beacons.

11. A method for in-flight target coordination of at least a leading guided ordnance and an trailing guided ordnance, the method comprising:

capturing, by the trailing guided ordnance, images of a scene aligned with an ordnance axis of the trailing guided ordnance;

emitting, by a leading guided ordnance, an optical beacon in an aft direction of travel by the leading guided ordnance, thereby communicating to the trailing guided ordnance;

identifying, by the trailing guided ordnance, within the captured images, the optical beacon emitted by the leading guided ordnance; and charting, by the trailing guided ordnance, a trajectory of the leading guided ordnance.

12. The method of claim 11, wherein the trajectory of the leading guided ordnance is charted based on the identified optical beacon emitted by the leading guided ordnance.

13. The method of claim 11, further comprising:

identifying, by the trailing guided ordnance, a plurality of image portions within the captured images, each corresponding to one of a plurality of targets in the aligned scene;

predicting, by the trailing guided ordnance, a first target of the plurality of targets selected by the leading guided ordnance, the first target corresponding to a first one of the plurality of image portions, the first target predicted based on the charted trajectory of the leading guided ordnance; and selecting, by the trailing guided ordnance, a second target corresponding to a second one of the plurality of image portions, the second target located within a navigable range of the trailing guided ordnance.

14. The method of claim 13, further comprising:

determining, by the trailing guided ordnance, a direction of the second target relative to the ordnance axis; and generating, by the trailing guided ordnance, an output signal indicative of the determined direction of the selected target relative to the ordnance axis.

15. The method of claim 11, further comprising:

projecting, by the leading guided ordnance, within the captured images, the optical signal projected by the leading guided ordnance.

16. The method of claim 15, further comprising:

identifying, by the trailing guided ordnance, within the captured images, the optical signal projected by the leading guided ordnance.

17. The method of claim 11, further comprising:

modulating, by the leading guided ordnance, the optical beacon to communicate information to the trailing guided ordnance.

18. A system configured to be carried by a guided ordnance for in-flight target coordination with other guided ordnances, the system comprising:

a microprocessor; and computer-readable memory encoded with instructions that, when executed by the microprocessor, cause the system to:

capture images of a scene aligned with an ordnance axis;

emit a first optical beacon in an aft direction of ordnance travel, thereby communicating to trailing guided ordnances;

identify, within the captured images, a second optical beacon emitted by a leading guided ordnance; and chart a trajectory of the leading guided ordnance.

* * * * *